United States Patent [19]

Nilssen

[11] Patent Number: 4,634,932

[45] Date of Patent: Jan. 6, 1987

[54] LIGHTING SYSTEM

[76] Inventor: Ole K. Nilssen, Caesar Dr., Barrington Hills, Ill. 60010

[21] Appl. No.: 729,074

[22] Filed: Apr. 30, 1985

Related U.S. Application Data

[63] Continuation of Ser. No. 447,304, Jan. 18, 1983, abandoned.

[51] Int. Cl.[4] ..... H05B 37/00; H05B 41/00

[52] U.S. Cl. ..... 315/119; 315/DIG. 5; 315/DIG. 7; 315/127; 363/50; 363/56; 363/25; 361/87; 361/101

[58] Field of Search ..... 315/119, 127, 124, DIG. 7, 315/DIG. 5; 363/50, 56, 19, 25, 23, 26, 18; 361/86, 87, 101

[56] References Cited

U.S. PATENT DOCUMENTS

| | | | |
|---|---|---|---|
| 3,386,005 | 5/1968 | Roland et al. | 363/50 X |
| 3,531,711 | 9/1970 | Fusco | 363/56 |
| 3,611,021 | 10/1971 | Wallace | 331/113 A |
| 3,725,739 | 4/1973 | Griffey | 363/56 X |
| 3,896,336 | 7/1975 | Schreiner et al. | 315/226 |
| 3,953,780 | 4/1976 | Anderson | 363/18 |
| 4,060,751 | 11/1977 | Anderson | 315/209 R |
| 4,103,356 | 7/1978 | Finlay | 331/113 A |
| 4,127,798 | 11/1978 | Anderson | 331/113 A |
| 4,199,710 | 4/1980 | Knoll | 315/205 |
| 4,210,846 | 7/1980 | Capewell | 315/127 |
| 4,259,614 | 3/1981 | Kohler | 315/DIG. 7 |
| 4,330,816 | 5/1982 | Imazeki et al. | 363/26 |
| 4,453,193 | 6/1984 | Huang et al. | 363/50 |

OTHER PUBLICATIONS

"Overcurrent Protected DC to DC Converter", by Louv Technical Digest, No. 45, pp. 25–26, Jan. 1977.

*Primary Examiner*—Saxfield Chatmon

[57] ABSTRACT

Subject invention constitutes a low-voltage limited-power (Class 2) fluorescent lighting system consisting of the following principal component parts: (a) a power-line-operated inverter power supply that provides a power-line-isolated voltage output of relatively low but substantially constant magnitude (30 Volt RMS) and relatively high frequency (30 kHz); (b) electronic means for preventing the power supply current output from exceeding a pre-determined relatively modest magnitude (8 Amp RMS); (c) a number of fluorescent lighting units, each unit consisting of one or more fluorescent lamps and a corresponding high-frequency ballasting means being adapted to be operated at a high power factor from the voltage output of said power supply; and (d) a pair of conductor wires connected with the output of said power supply and adapted to permit a number of said fluorescent lighting units to be connected in parallel across said voltage output at various points along said pair of wires. The invention provides for a high-efficiency fluorescent lighting system that consists of a number of fixtured and/or non-fixtured lighting units that can easily and safely be installed by a person of but ordinary skills; yet, even with output power limited to 100 Watt, is capable of providing a total amount of illumination that is equivalent to that provided by over ten ordinary 60 Watt incandescent lamps.

15 Claims, 3 Drawing Figures

LIGHTING SYSTEM

This is a continuation of application Ser. No. 447,304, filed on Jan. 18, 1983 now aband.

BACKGROUND OF THE INVENTION

1. Field of the Invention

The present invention relates to power-line-operated low-voltage limited-power fluorescent lighting systems.

2. Description of Prior Art

To the best of my knowledge, no power-line-operated low-voltage limited-power fluorescent lighting system is available for purchase or has been described in published literature.

3. Rationale Related to the Invention

Due to potential shock and fire hazards, presently available power-line-operated electric lighting fixtures can not conveniently and safely be installed by persons of but ordinary skills.

On the other hand, if lighting fixtures could be powered by way of so-called Class 2 transformers (for definition of such transformers, see report entitled UL 506 Specialty Transformers by Underwriters Laboratories Inc., Northbrook, IL 60062), they could indeed conveniently and safely be installed by persons of but ordinary skills.

However, the output of Class 2 transformers is strictly limited in maximum voltage (30 Volt RMS), maximum Volt-Amperes (100 VA) and maximum current (8 Amp RMS); and would not appear to yield enough power to provide an amount of illumination that would be considered adequate in a substantial number of ordinary lighting system installations—at least not if based on using incandescent lamps. Moreover, because of the significant internal impedance normally associated with Class 2 transformers, a very poor voltage-versus-load regulation would result.

Yet, if neglecting the problem of voltage-versus-power regulation and if using fluorescent lamps, it should be possible to get worthwhile amounts of illumination from a Class 2 transformer—although the cost and complexity associated with the requisite voltage transformations and ballasting might seem to make this approach cost-effectively prohibitive.

Against this background, a fluorescent lighting system based on a combination of the following perceptions appears useful.

(a) By making the output of a Class 2 transformer a voltage of relatively high frequency (30 kHz), the requisite voltage transformations and ballasting would become particularly simple to accomplish at modest cost and with high efficiencies.

(b) A power-line-operated inverter can cost-effectively be made to provide a voltage output of substantially constant amplitude and of relatively high frequency (30 kHz).

(c) Means can readily be provided by which the inverter will stop operating (thereby ceasing to provide an output) if at any time the output current exceeds a pre-specified magnitude (such as 8 Amp RMS), thereby negating the need for the relatively high internal impedance normally required of a Class 2 transformer.

(d) Fluorescent lamps operated by way of high frequency ballasts can readily be made to draw power with a power factor of nearly 100%.

(e) Thus, without violating the restrictions associated with the Class 2 specifications, a low-voltage limited-power fluorescent lighting system can be made to operate at a power level of up to 100 Watt; which, based on realistically attainable luminous efficacies with currently available high-efficiency fluorescent lamps, can provide for a total light output of up to 10,000 Lumens—which is to say: an amount of light output equivalent to that obtained from more than ten ordinary 60 Watt incandescent lamps. In other words, a Class 2 fluorescent lighting system can provide an amount of light that is adequate for the total lighting requirements of several rooms in a home.

SUMMARY OF THE INVENTION

Objects of the Invention

A first object of the present invention is that of providing a high-efficiency, cost-effective and easy-to-install fluorescent lighting system.

A second object is that of providing a fluorescent lighting system that can readily and safely be installed by persons of but ordinary skills.

A third object is that of providing means by which fluorescent lighting fixtures can safely and easily be installed by the do-it-yourself'er without requiring the assistance of an electrician.

These as well as other objects, features and advantages of the present invention will become apparent from the following description and claims.

Brief Description

Subject invention relates to a low-voltage limited-power (Class 2) fluorescent lighting system and consists of the following principal component parts:

(a) a power-line-operated inverter power supply that provides a power-line-isolated voltage output of relatively low but substantially constant magnitude (30 Volt RMS) and relatively high frequency (30 kHz);

(b) electronic means for preventing the power supply current output from exceeding a pre-determined relatively modest magnitude (8 Amp RMS);

(c) a number of fluorescent lighting units, each unit consisting of one or more fluorescent lamps and a corresponding high-frequency ballasting means being adapted to be operated at a high power factor from the voltage output of said power supply;

(d) a pair of conductor wires connected with the output of said power supply and adapted to be easily routable to the various points at which fluorescent lighting units might be fixtured or at which receptacle connectors for such fluorescent lighting units might be installed; and (c) coupling means to permit fixtured and/or non-fixtured electrical connections between such fluorescent lighting units and said pair of conductors wires.

DESCRIPTION OF THE PREFERRED EMBODIMENT

Figure 1:
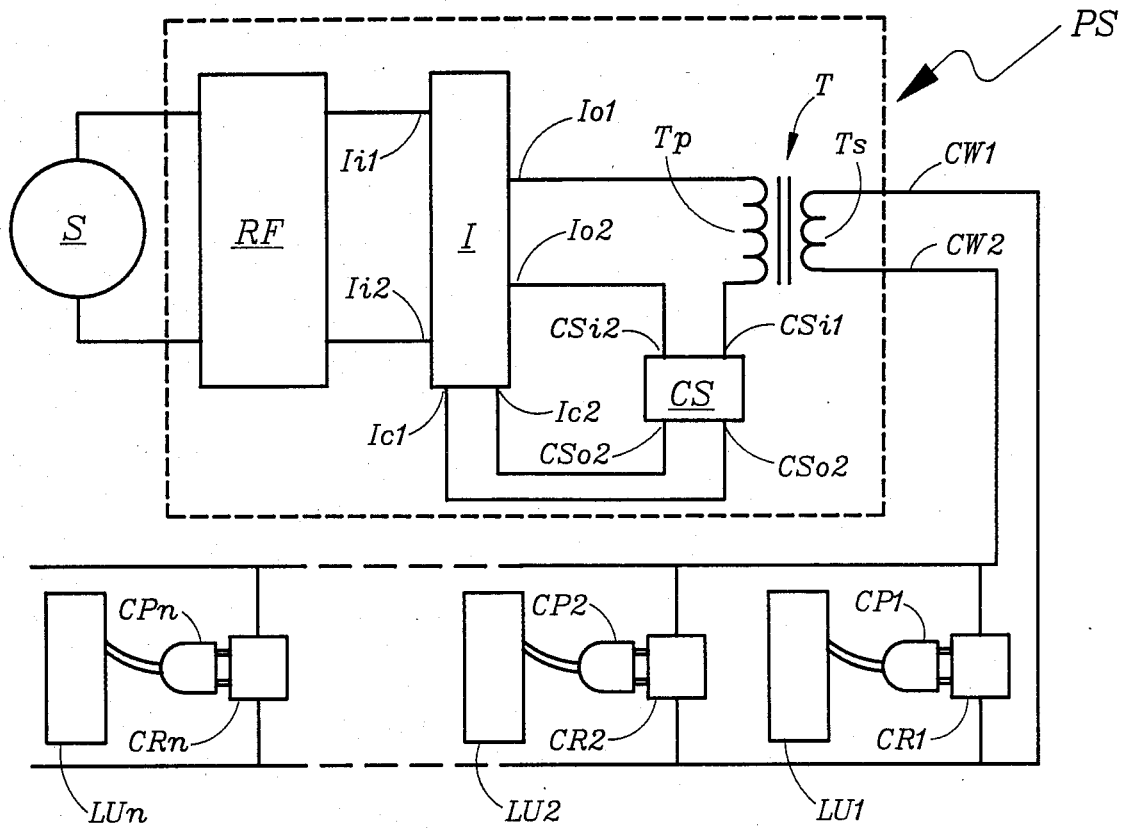
FIG. 1 schematically illustrates the preferred embodiment of the invention and shows a power-line-operated inverter with its output provided, by way of a step-down power-line-isolating transformer and a current sensor, to a pair of conductor wires across which are connected, by way of receptacle and plug means, a number of individual fluorescent high-power-factor lighting units.

In FIG. 1, a source S of 120 Volt/60 Hz voltage is applied to a rectifier-filter combination RF, the substantially constant DC output voltage of which is applied to an inverter I at its power input terminals Ii1 and Ii2.

The output from the inverter, which is provided across its power output terminals Io1 and Io2, is an AC voltage of about 30 Volt RMS magnitude and 30 kHz frequency, which AC voltage is applied to the primary winding Tp of a transformer T by way of input terminals Csi1 and Csi2 of a current sensor CS.

The output from current sensor CS is applied by way of sensor output terminals CSo1 and CSo2 to inverter control input terminals Ic1 and Ic2.

The output of the transformer is provided from its secondary winding Ts and is applied to a pair of conductor wires CW1 and CW2, across which are connected a number n of fluorescent lighting units LU1, LU2–LUn. These lighting units are connected to the conductor wires by way of corresponding electrical connection plugs CP1, CP2–CPn and connection receptacles CR1, CR2–CRn.

The assembly consisting of rectifier-filter means RF, inverter I, current sensor CS and transformer T is referred to as power supply PS.

Figure 2:
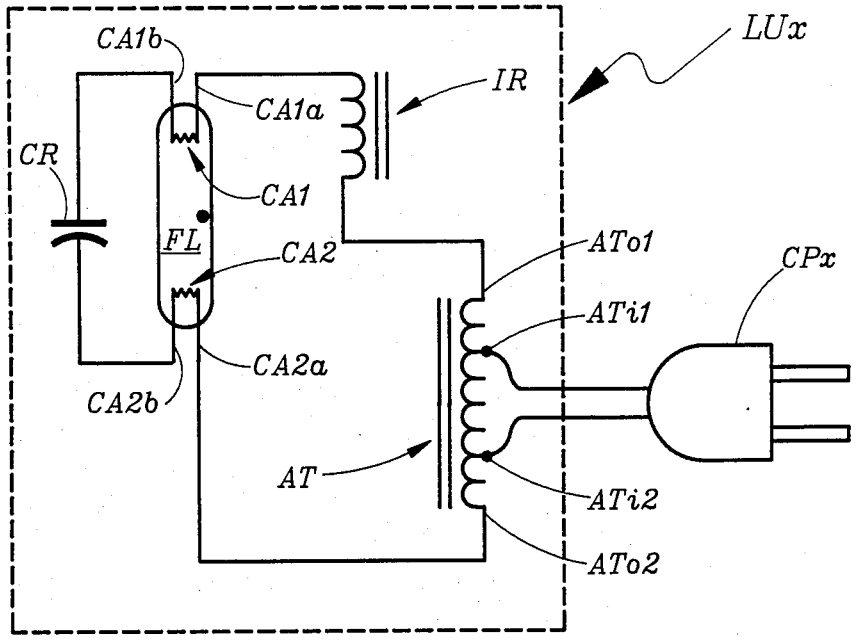
FIG. 2 illustrates details of an individual fluorescent lighting unit consisting of a single fluorescent lamp and a high-power-factor (resonant) ballasting means.

FIG. 2 illustrates one of the n lighting units referred to as LU1, LU2–LUn. This one lighting unit is referred to as LUx and consists of a voltage-step-up auto-transformer AT, an inductive reactor means IR, a fluorescent lamp FL, a capacitive reactor means CR, and a connection plug CPx.

The fluorescent lamp has two cathodes CA1 and CA2, each of which has two electrical connection terminals. Those of CA1 are referred to as CA1*a* and CA1*b*; and those of CA2 are referred to as CA2*a* and CA2*b*.

The auto-transformer's input terminals ATi1 and ATi2 are connected directly with connection plug CPx, and its output terminals ATo1 and ATo2 are connected to the sub-assembly consisting of IR, FL and CR.

The inductive reactor means IR is connected between auto-transformer ouput terminal ATo1 and terminal CA1*a* of cathode CA1. The capacitive reactor means CR is connected between terminal CA1*b* of cathode CA1 and terminal CA2*b* of cathode CA2. Terminal CA2*a* of cathode CA2 is connected directly with auto-transformer output terminal ATo2.

Figure 3:
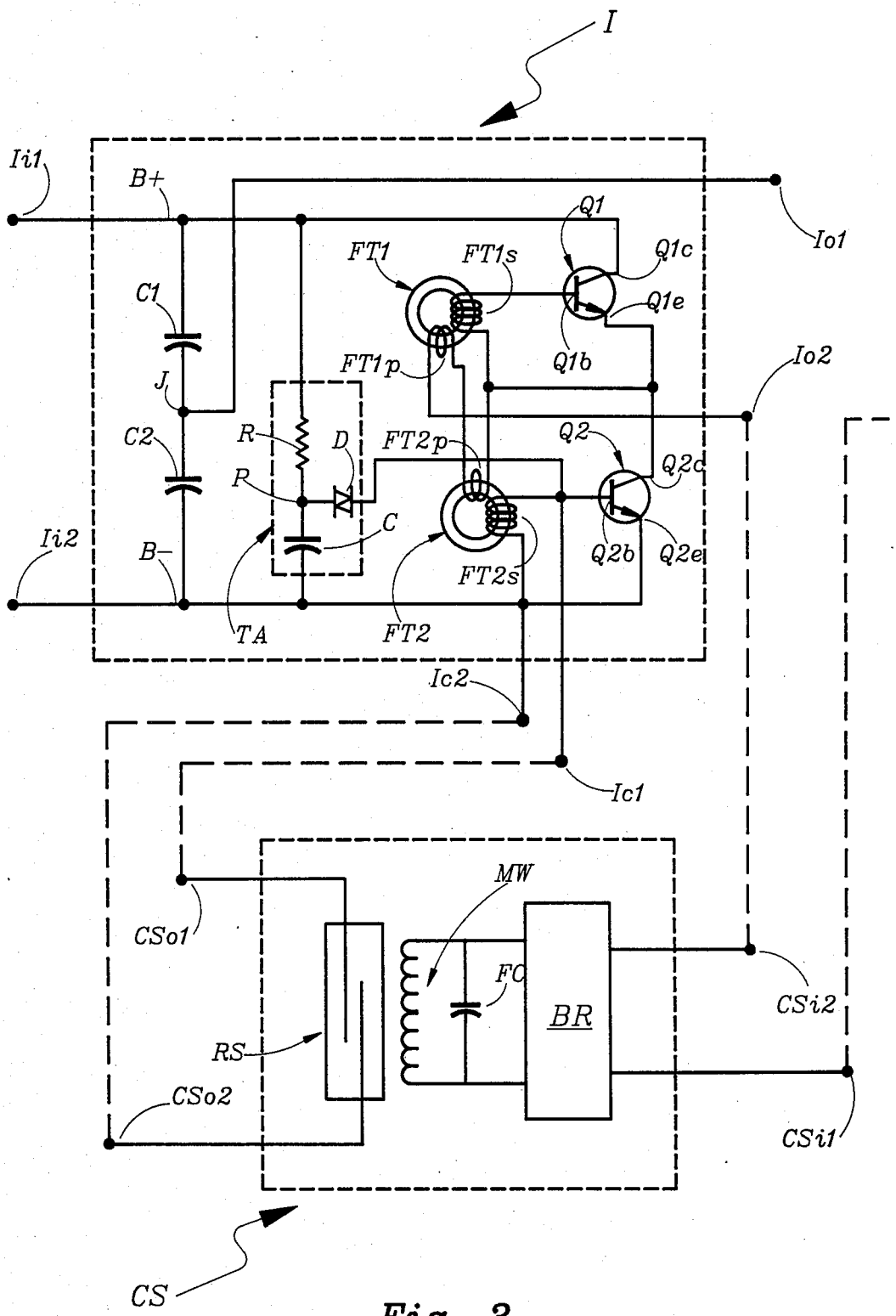
FIG. 3 illustrates details of the inverter, including details of the current sensor and the means by which the inverter is disabled if the transformer output current exceeds a pre-set maximum level.

FIG. 3 illustrates circuit details of inverter I as well as of current sensor CS.

Inverter I is of a basic design described in connection with FIG. 8 of U.S. Pat. No. 4,184,128 issued to Nilssen and entitled High Efficiency Push-Pull Inverters.

The inverter circuit consists of two NPN transistors Q1 and Q2 connected in series between the B+ and the B− terminals, across which is provided the unidirectional voltage output of the combination rectifier/filter referred to as RF in FIG. 1.

Respectively, transistors Q1 and Q2 have collectors Q1*c* and Q2*c*, emitters Q1*e* and Q2*e*, and bases Q1*b* and Q2*b*.

Collector Q1*c* is connected directly to the B+ terminal, which is connected directly with inverter power input terminal Ii1; emitter Q1*e* of transistor Q1 is connected directly with collector Q2*c* of transistor Q2; and emitter Q2*e* is connected directly to the B− terminal, which is connected directly with inverter power input terminal Ii2.

The secondary winding FT1*s* of saturable feedback transformer FT1 is connected directly between base Q1*b* and emitter Q1*e* of transistor Q1; and the secondary winding FT2*s* of saturable feedback transformer FT2 is connected directly between base Q2*b* and emitter Q2*e* of transistor Q2.

A pair of series-connected capacitors C1 and C2 are connected together at junction J, and the resulting series-combination is connected between the B+ and the B− terminals, in parallel with the two transistors.

The output of the inverter is provided to output terminals Io1 and Io2: Io1 is connected directly with junction J; Io2 is connected with emitter Q1*e* and collector Q2*c* by way of the series-connected primary windings FT1*p* and FT2*p* of saturable feedback transformers FT1 and FT2, respectively.

Inverter control input terminal IC1 is connected directly with base Q2*b* of transistor Q2; and inverter control input terminal Ic2 is connected directly with emitter Q2*e* of the same transistor Q2.

A trigger arrangement TA consists of a resistor R, a capacitor C and a Diac D. Resistor R is connected between the B+ terminal and point P; capacitor C is connected between point P and the B− terminal; and diac D is connected between point P and base Q2*b*.

Current sensor CS consists of a full bridge rectifier BR connected with its input directly between input terminals CSi1 and CSi2. The unidirectional current output of this full bridge rectifier is applied to the magnetizing winding MW of a magnetic reed switch RS. A filter capacitor FC is connected across the magnetizing winding MW.

The reed switch RS, which is of a type that is open in its non-activated state (i.e., normally open), is connected directly across output terminals CSo1 and CSo2 of current sensor CS.

The operation of the system of FIG. 1, may best be explained by first explaining the operation of the inverter circuit and the current sensor of FIG. 3.

The basic operation of the half-bridge inverter of FIG. 3 is explained in detail in connection with FIG. 8 of U.S. Pat. No. 4,184,128 as referenced above. However, in the instant situation, the important points of operation are as follows.

The inverter is triggered into oscillation by the trigger arrangement TA; which arrangement provides for periodic trigger pulses to be applied to base Q2*b* of transistor Q2. In the absence of such trigger pulses, the inverter will not start oscillating.

The frequency with which these trigger pulses are applied to base Q2*b* is determined by the values of capacitor C and resistor R as well as the magnitude of the B+ voltage. In the instant situation, this frequency has been chosen to be approximately once every 30 seconds.

Once the circuit has been triggered into oscillation, this oscillation will continue indefinitely—until it is overtly stopped, as for instance by removing B+ power or by disrupting the positive feedback action.

A safe and effective way of disrupting the positive feedback action is that of providing for a momentary control action, such as a momentary short circuit between the base and emitter of one of the transistors.

Once circuit oscillation has been stopped, it will not restart until a trigger pulse is provided.

The current sensor CS is operative to cause the reed switch SW to close if the current flowing through its magnetizing winding MW exceeds a certain level. In the instant situation, this level has been so chosen that it is reached before the current provided at the output of transformer T exceeds eight Amp RMS.

With the output terminals of the current sensor connected with the inverter input control terminals as shown, and in case excessive current is drawn from the output of transformer T, the reed switch will close and provide for a short circuit between the base and emitter of transistor Q2. This short circuit will cause circuit oscillation to cease, with the result that the output current from transformer T will cease to flow.

Of course, when this output current ceases to flow, the reed switch will re-open; which means that the Q2 base-emitter short circuit will disappear, thereby permitting oscillation to be re-started. However, the circuit will not start oscillating again until a trigger pulse is provided; and, after such an initial shut-down, it will take an average of about 15 seconds before that will occur.

After this average delay of about 15 seconds, when a trigger pulse is provided, the circuit will attempt to re-start. If now the excessive load condition has dissappeared, the oscillation will indeed re-start and continue in its normal fashion. However, if the excessive load condition still persists, the oscillation will again immediately stop—remaining stopped for the next 30 seconds or so before attempting another re-start.

Thus, based on an inverter circuit and current sensor as described above in connection with FIG. 3, the operation of the system of FIG. 1 may be explained as follows.

In its normal state of operation, the inverter provides a 30 kHz squarewave voltage across its output terminals Io1 and Io2. This voltage is applied to the primary winding of transformer T. The transformer turns-ratio is so chosen as to provide a secondary voltage of 30 Volt RMS magnitude across the secondary winding; which secondary voltage is applied directly across the two conductor wires CW1 and CW2.

By providing electrical isolation between the primary and the secondary winding of the transformer T, the two conductor wires are kept electrically isolated from the inverter—and thereby from the power line.

Along the two conductor wires and connected thereto, at any place where it might be desirable to connect a lighting unit, is placed a connection receptacle. By way of these connection receptacles (CR1, CR2–CRn) and the connection plugs on each lighting unit (CP1, CP2–CPn), any number of lighting units (LU1, LU2–LUn) may be connected with and along the conductor wires (CW1 and CW2).

Of course, to prevent the current sensor (CS) from shutting off the inverter circuit, it is necessary that the total net effective current drawn by all the lighting units connected to the conductor wires stay within the pre-set maximum current limit.

In order to permit a maximum amount of lighting power to be derived from the inverter circuit within the pre-set maximum current, it is important that the high frequency (30 kHz) power used by the lighting units be drawn with a high power factor. In fact, up to the maximum possible power factor value of 100%, the available lighting power will be directly proportional to the magnitude of this power factor.

The fluorescent lamp ballasting arrangement illustrated by FIG. 2 provides for an exceptionally high power factor. In fact the magnitude of the capacitive reactor means CR is chosen such as to cause the overall lamp ballasting arrangement to be resonant at the fundamental component of the applied high frequency (30 kHz) voltage; which principally means that capacitor CR is chosen so as to provide for substantial resonance with inductor IR.

As a consequence of such substantially resonant ballast operation, the power used by each lighting unit will be drawn with a power factor of approximately 90%; which is the best that can be attained in a situation of having a squarewave voltage and a sinewave current.

And, of course, with resonant operation, the current drawn by the various lighting units (and thereby though the two conductor wires) will be sinusoidal in waveshape; which has the distinct advantage of providing for a minimum of radio frequency interference—especially as compared with having a squarewave current.

In FIG. 2, aside from the resonant combination of inductive reactor IR and capacitive reactor CR (which combination can provide for a substantial step-up in the voltage applied across the fluorescent lamp FL as compared with the voltage provided at the input to the series-resonant circuit consisting of IR, CR and FL), it is with many types of fluorescent lamps necessary to provide for additional voltage step-up. Such additional step-up voltage transformation is provided by autotransformer AT.

Otherwise, further information about high frequency resonant fluorescent lamp ballasting is disclosed in my co-pending U.S. Patent Application entitled Series-Resonant Electronic Ballasts—filed Aug. 8, 1982 with Ser. No. 06/411,263.

Finally, it is noted that the entity referred to as PS in FIG. 1 is in actuality intgrated with an electrical connection plug suitable for direct insertion into an ordinary household power receptacle, in fashion analogous to that described in another co-pending U.S. patent application of mine entitled Frequency Converters for Mounting on Power Cords and Plugs—filed May 19, 1982 with Ser. No. 06/379,670.

It is believed that the present invention and its several attendant advantages and features will be understood from the preceeding description. However, without departing from the spirit of the invention, changes may be made in its form and in the construction and interrelationships of its component parts, the form herein presented merely representing the preferred embodiment.

I claim:

1. A lighting system adapted to be powered from a source of DC voltage and comprising:

inverter conditionally operative to convert the DC voltage into an AC voltage provided at a pair of output terminals, the inverter being capable of self-oscillating through positive feedback by way of a feedback circuit, thereby to provide said AC voltage and operable by way of momentary disruption of the positive feedback to be brought out of oscillation, thereby to cease to provide said AC voltage;

lighting means connected with said output terminals; and current sensing means connected in circuit with said output terminals and said feedback circuit and operative, in case current drawn from these output terminals exceeds a pre-determined magnitude, to provide said momentary disruption of the positive feedback, thereby to cause the inverter to be brought out of oscillation, thereby substantially to remove the AC voltage from said terminals.

2. The lighting system of claim 1 wherein the inverter will automatically be re-triggered into oscillation some period of time after it has been triggered out of oscillation, said period of time being substantially longer than the period of the waveform of said AC voltage.

3. The lighting system of claim 1 wherein said source of DC voltage is operative to provide power output to a degree that is considered potentially unsafe in respect to fire initiation hazard, and wherein said inverter comprises limiting means operative to limit the power available from said output terminals to a level that is considered safe in respect to fire initiation hazard in accordance with the guidelines of a recognized authority such as the National Electrical Code.

4. The lighting system of claim 1 wherein the magnitude of said AC voltage is such as under normal circumstances not to represent a significant electric shock hazard to a person directly touching said output terminals.

5. A lighting system adapted to be powered from a source of DC voltage and comprising:

inverter means connected with said source and conditionally operable to provide an AC voltage at a pair of output terminals, said inverter means having a control input and being operable, upon receipt of a momentary control action at said control input, to substantially remove said AC voltage for a length of time that substantially exceeds the duration of said control action as well as the period of said AC voltage;

sensing means connected in circuit between said output terminals and said control input and operative, in case the volt-amperes flowing from these output terminals exceeds a magnitude that is considered by a recognized authority, such as Underwriters Laboratories Inc., as being safe from potential fire initiation hazard, to provide said momentary control action; and lighting means disconnectably connected with said output terminals;

whereby the output provided from said output terminals is manifestly prevented from ever being so large as to constitute a potential fire initiation hazard.

6. A power supply arrangement operable to provide AC power to a lighting means, comprising:

inverter adapted to connect with a source of DC and, when so connected, operable to provide an AC voltage at an output, said inverter being conditionally self-oscillating through positive feedback by way of a feedback circuit, thereby to provide said AC voltage and operable by way of momentary disruption of the positive feedback to be brought out of oscillation, thereby to cease to provide said AC voltage; and current sensing means connected in circuit with said output and said feedback circuit and operative, in case current drawn from said output exceeds a pre-determined magnitude, to provide said momentary disruption of positive feedback, thereby to cause the inverter to be brought out of oscillation, thereby removing said AC voltage from said output for a period of time, said period of time having a duration longer than the period of said AC voltage.

7. The power supply of claim 6 and means operative to trigger the inverter back into oscillation after said period of time.

8. An inverter means operable to convert a DC voltage into an AC voltage suitable for powering a lighting means, comprising:

switching transistor means connected with said DC voltage and having a set of power output terminals and a set of control input terminals;

positive feedback means connected in circuit between said output terminals and said control input terminals and operative, after having received a momentary initiation signal at said control input terminals, to cause said switching transistor means to enter a mode of conditionally stable oscillation, thereby to provide an AC voltage at said output terminals; and disable means connected with said control input terminals and having a disable input, the disable means being operative to cause said switching transistor means to exit said mode of conditionally stable oscillation in response to a momentary control action provided at said disable input, thereby to remove said AC voltage from said output terminals.

9. The inverter means of claim 8 and sensor means connected in circuit between said output terminals and said disable input, and operative to provide said momentary control action in case the magnitude of the current flowing from said output terminals exceeds a pre-determined level.

10. The inverter means of claim 9 and means operative, some period after said transistor means has been caused to exit said conditionally stable mode of oscillation, to provide said initiation signal, thereby to cause said transistor means to re-enter said conditionally stable mode of oscillation, the duration of said period being substantially longer than that of a complete cycle of said AC voltage.

11. The inverter means of claim 8 wherein said DC voltage is of substantially constant magnitude.

12. The inverter means of claim 8 wherein said AC voltage may be removed from said output terminals wihtout having to remove said DC voltage.

13. An inverter means operable to convert a DC voltage into an AC voltage suitable for powering a lighting means, comprising:

switching transistor means connected with said DC voltage and having a set of power output terminals and a set of control input terminals;

positive feedback means connected in circuit between said output terminals and said control input terminals and operative: (i) in response to a momentary initiation signal and by positive feedback to cause said transistor means to enter a mode of stable oscillation, thereby to provide an AC voltage at said output terminals, and (ii) in response to a momentary disruption of positive feedback to cause said transistor means to exit from said mode of stable oscillation, thereby to remove said AC voltage from said output terminals; and means operable conditionally to provide said initiation signal and said disruption of positive feedback.

14. An inverter means operable to convert a DC voltage into an AC voltage suitable for powering a lighting means, comprising:

switching transistor means connected with said DC voltage and having a set of power output terminals and a set of control input terminals;

positive feedback means connected in circuit between said output terminals and said control input terminals and operative, (i) in response to a momentary initiation signal and by way of positive feedback to cause said transistor means to enter a mode of stable oscillation, thereby to provide an AC voltage at said output terminals, and (ii) in response to a momentary disruption of positive feedback to cause said transistor means to exit from said mode of stable oscillation, thereby to remove said AC voltage from said output terminals; and means operable, in case said transistor means has not existed in said mode of stable oscillation for a period of time, to automatically provide said initiation signal.

15. The inverter means of claim 14 and means connected in circuit with said output terminals and operative, in case the magnitude of the current flowing therefrom exceeds a pre-determined level, to provide said disruption of positive feedback, thereby to remove said AC voltage for said period of time.

* * * * *

Disclaimer 4,634,932.—*Ole K. Nilssen*, Barrington, Hills, Ill. LIGHTING SYSTEM. Patent dated Jan. 6, 1987. Disclaimer filed Feb. 2, 1990, by the inventor.

The term of this patent subsequent to December 2, 2003, has been disclaimed.

[ *Official Gazette April 24, 1990* ]